United States Patent [19]

Nunes

[11] 4,328,606

[45] May 11, 1982

[54] VERTICAL PLURAL TUBULAR VAULT BURIAL SYSTEM

[76] Inventor: Abner H. Nunes, 1854 Mahana St., Honolulu, Hi. 96816

[21] Appl. No.: 150,477

[22] Filed: May 16, 1980

Related U.S. Application Data

[60] Continuation of Ser. No. 651,663, Jan. 22, 1976, abandoned, which is a division of Ser. No. 122,780, Mar. 10, 1971, Pat. No. 3,940,894.

[51] Int. Cl.[3] ..... A61G 17/00

[52] U.S. Cl. ..... 27/35

[58] Field of Search ..... 27/2, 35

[56] References Cited

U.S. PATENT DOCUMENTS 2,927,453 3/1960 Patterson et al. ..... 27/35 X 3,348,280 10/1967 Myers ..... 27/2

3,581,452 6/1971 Jalbert ..... 27/35

3,898,718 8/1975 Eubank ..... 27/35

*Primary Examiner*—John D. Yasko

*Attorney, Agent, or Firm*—James C. Wray; John D. Hubbard

[57] ABSTRACT

A plurality of elongated concrete tubular vaults are arranged upright resting on closed lower ends and are interconnected in mutual lateral support, leaving auxiliary spaces between the vaults. End-opening tubular caskets are vertically disposed in the vaults and the vaults are closed by step-fitted covers. Threaded central openings in the covers of the vaults and the caskets receive ring bolts for lowering the casket into the vault and lowering the vault cover to close the vault.

10 Claims, 5 Drawing Figures

FIG. 2
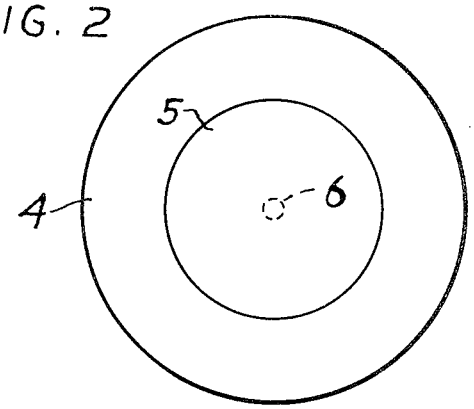
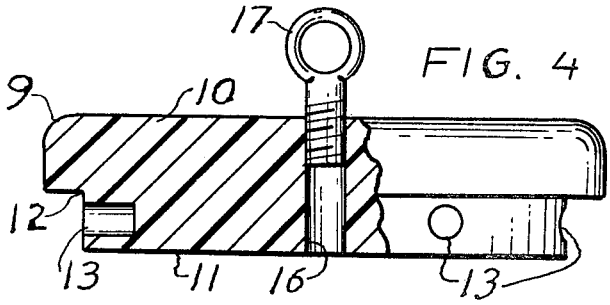
FIG. 4
FIG. 3
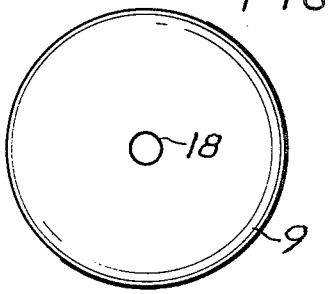
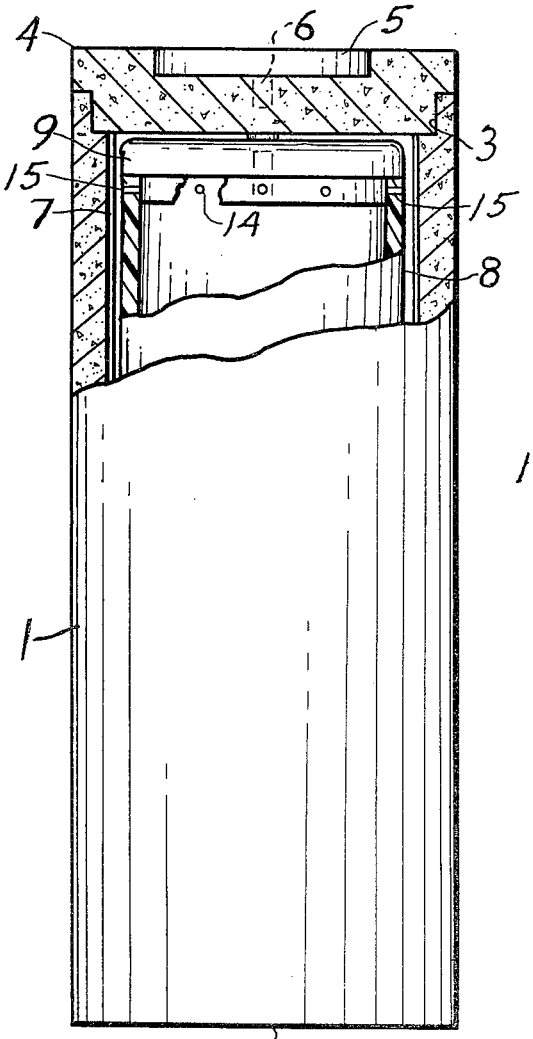
FIG. 1
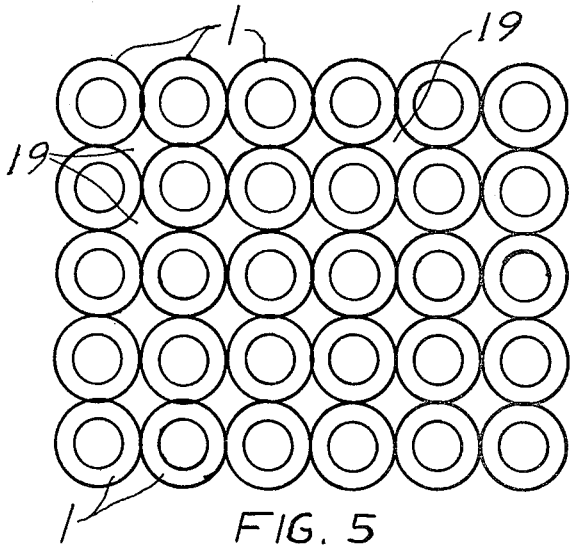
FIG. 5

VERTICAL PLURAL TUBULAR VAULT BURIAL SYSTEM

This is a continuation division of application Ser. No. 651,663, filed 1-22-76, now abandoned, which is a division of patent application Ser. No. 122,780 filed Mar. 10, 1971, now U.S. Pat. No. 3,940,894.

This invention concerns improvement is burial caskets and means to conserve space in cemeteries and the like. Ground space for burials in many places is becoming scarce and especially where many people wish to bury their loved ones in cemeteries which have reached their capacity to accommodate more bodies under existing conditions; for instance where the boundries of cemeteries are surrounded by built-up communities such as homes and city buildings and land which cannot be acquired by purchase or because of city and state ordinances. Thus such cemeteries cannot be extended.

In accordance to the aims of this invention, three or more bodies can be respectfully buried and cared for in the space usually required for by one body. This is especially so where a single person is buried in a single grave as now generally practiced.

One of the principal objects of this invention is to arrange burial wherein the body is stood upright in a sealed capsule and which capsule is inserted into an upright casing that is accommodated in a hole in the ground and wherein the casing itself is also sealed. Many casings are employed in adjacent relationship, and when the casings are cylindrical, a space is reserved between them for the burial of the ashes of deceased persons and/or pets.

Another object is to seal transparent capsules so that the remains of a person or pet can be viewed at times of a funeral and which capsule is provided with means so that the air can be exhausted therefrom and if desired a preserving gas can be egressed into the capsule for there are times when it is an advantage to preserve a body for various purposes.

A further object is to provide an economical means and system for burials along with means for economical manufacture of the capsules and the ground casings.

In the drawings:

FIG. 1 is an elevational view of a capsule within a ground casing with parts broken away to show certain parts in section;

FIG. 2 is a plan view of the top portion of that shown in FIG. 1;

FIG. 3 is a top plan view of the capsule per se;

FIG. 4 is an enlarged sectional view of the closure cap means of the capsule;

FIG. 5 is a plan view of a cemetery ground area showing how a large number of upright burial sites can be arranged.

The particular form, as illustrated, shows a ground casing 1 which may be concrete or made of any other suitable material which can be economically employed for such a purpose. The casing may be of any suitable configuration such as a tube that may be round or oval, but in this case it is shown as a cylinder having the bottom 2 and an open top having a rabbet formation as indicated at 3. A cover means or capping means 4 plugs the open top of the cylinder 1, and its periphery is stepped or rabbeted to conform with the rabbet portion 3. This cover means may also be concrete or other suitable material. There is a plate 5 countersunk and perhaps removable if desired and which is for inscriptions regarding the person buried and perhaps numbered in accordance so some system. This plate may have any suitable configuration and may be permanently fixed in place by cement or other means. A threaded portion 6 may be provided to receive a hook or eye so that the cover 4 can be easily removed at time of burial. The casing is lined as shown at 7, and the lining may be glass or colored plastic material for decorative purposes and also to act as a seal to prevent entrance of ground moisture to the capsule which is shown at 8.

The capsule 8 is the casket for the body of the deceased, and means are provided to hold the body in a suitable display position whether or not this position is horizontal or vertical or some position in between. The capsule is made of glass or plastic material and may be colored, but in many cases the capsule is just plain clear glass or plastic. A sealing means of cover 9 is shown and consists of a round top portion 10 and an offset portion 11 as clearly shown in FIG. 4 (an enlargement). The portion 11 aids in forming the annular shoulder portion 12 and enters the capsule as a plug. This plug portion is provided with a plurality of holes or bores 13, and the top rim of the capsule is provided with similar bores 14. These bores are alined so that they can receive pegs 15 which may be plastic or of some other suitable material. The pegs are sized so that they can be tightly driven into the bores and thus hold the top 9 to its capsule 8. Sealing means such as a suitable cement may be employed.

The capsule top cover means is provided with a bore 16, and the top portion thereof is threaded to receive the threaded end of an eye member 17 as shown in FIG. 4. The bore 6, in cover 4 of casing 1 is also provided with threads to receive the eye member 17 so that a suitable lift means is provided for raising these covers and for carrying the capsule from place to place. The bore 16 has another use and an important one. The threaded portion of this bore 16 can be attached to or coupled with a suitable exhausting machine so that air in the capsule can be withdraw. A suitable degree of vacuum will aid in preserving the body placed in the capsule. Also, an inert gas may be forced into the capsule, and this is another means for preserving the body. The item 18 is a cap designed to close the bore 16 and this cap should be cemented in place after use of the exhaust machine.

FIG. 5 shows a group of ground casings 1 which are arranged as shown, that is, to save ground space, they are placed side-by-side in close formation and this arrangement provides spaces 19 into which ashes of deceased persons can be placed. In this case, a suitably configurative capsule is placed in these spaces 19 and then provided with a concrete cover. Obviously, the shape of the capsules, ground casings and spaces 19 will conform with the design of such items, and their associated parts such as covers will have a proper design to fit their respective capsules, casings and spaces such as 19. It may be preferred to design the casings, capsules and covers as shown, but other forms may be imployed such a oval tubes, square tubes, triangle tubes etc. Cylindrical forms are preferred in that they provide the spaces 19.

I claim:

1. A plural vertical tubular vault burial system, comprising a plurality of vertically elongated concrete vaults having substantially horizontal closed bottom ends and being laterally connected to each other in vertical elongated areas extending substantially along an entire vertical length of the vaults, and elongated vertically disposed and laterally confined spaces formed by outer surfaces of adjacent vaults, which spaces are longitudinally coextensive with the vaults, the vaults having upward openings for receiving caskets vertically disposed in the vaults and the spaces between the vaults having upward opening for receiving other materials to be buried, and further comprising end cover means for placing on the vaults.

2. The system of claim 1 further comprising second cover means for placing on the vaults over the spaces between sides of the vaults.

3. The system of claim 1 wherein upper ends of the vaults are centrally recessed, and wherein the covers have projections which fit within the central recesses and have outward extending portions surrounding the projections for overlying upper ends of the vaults.

4. The system of claim 1 wherein the covers have central recesses for receiving plates.

5. The system of claim 4 wherein the covers have threaded eye bolt receiving holes centrally extending downward from the recesses for receiving eye bolt for lifting and resetting the covers, whereby the eye bolt receiving holes are covered by plates fitted within the recess.

6. The system of claim 1 wherein the vertically elongated tubular casings have smooth linings on inside lateral surfaces.

7. The system of claim 6 wherein the lining is plastic material.

8. The system of claim 6 wherein the lining is glass material.

9. The system of claim 1 wherein the vertical elongated vaults have cylindrical outer walls which abut with adjacent vaults in substantially linear vertical areas.

10. The system of claim 9 wherein the vaults have cylindrical inner walls.

* * * * *